United States Patent [19]

Yamasaki

[11] Patent Number: 4,918,438

[45] Date of Patent: Apr. 17, 1990

[54] PAGING RECEIVER HAVING AUDIBLE AND VIBRATOR ANNUNCIATING MEANS

[75] Inventor: Koji Yamasaki, Tokyo, Japan

[73] Assignee: NEC Corporation, Tokyo, Japan

[21] Appl. No.: 54,915

[22] Filed: May 28, 1987

[30] Foreign Application Priority Data

May 30, 1986 [JP] Japan ..... 61-123249

[51] Int. Cl.[4] ..... G08B 5/22

[52] U.S. Cl. ..... 340/825.46; 340/825.44; 340/825.48; 340/407

[58] Field of Search ..... 340/825.46, 825.44, 340/825.48, 311.1, 407, 309.4, 327, 328, 407

[56] References Cited

U.S. PATENT DOCUMENTS

| | | | |
|---|---|---|---|
| 3,623,064 | 11/1971 | Kagan et al. | 340/825.46 |
| 3,688,293 | 8/1972 | Sullivan | 340/328 |
| 3,911,416 | 10/1975 | Feder | 340/825.46 |
| 4,237,448 | 12/1980 | Weinberg | 340/825.44 |
| 4,352,091 | 9/1982 | Yamasaki | 340/311.1 |
| 4,392,135 | 7/1983 | Ohyagi | 340/825.46 |
| 4,419,668 | 12/1983 | Ganucheau, Jr. | 340/825.44 |
| 4,613,859 | 9/1986 | Mori | 340/825.44 |
| 4,755,816 | 7/1988 | DeLuca | 340/825.44 |

FOREIGN PATENT DOCUMENTS

| | | | |
|---|---|---|---|
| 2146153 | 4/1985 | United Kingdom | 340/825.44 |

*Primary Examiner*—Donald J. Yusko
*Assistant Examiner*—Edwin C. Holloway, III
*Attorney, Agent, or Firm*—Sughrue, Mion, Zinn, Macpeak & Seas

[57] ABSTRACT

A paging receiver which includes a conventional receiver circuit for receiving a paging signal, having a page number that identifies the intended recipient, a memory for storing a unique page number which is assigned to that particular receiver and a decorder for comparing the page number included in the received paging signal with the page number which is stored in the memory. If the stored and received page numbers coincide, detection pulse is produced that starts a first and a second timer. The first timer produces a mode switch pulse following the lapse of a first predetermined period of time. The second timer which has a period longer than first period of time, generates an auto-reset pulse upon lapse of its period. The mode switch pulse and the auto-reset pulse are sent to an annunciation mode switch having an output for driving both a tactile annunciator and an audible annunciator. The detection pulse causes the annunciator mode switch to energize one of the tactile and audible annunciators. When the mode switch pulse is generated by the first timer, the annunciator mode switch will drive the other of the two annunciators and turn the first annunciator off. Finally, the auto-reset pulse will cause the annunciation mode switch to turn off the second annunciator. A manual reset switch also provides a reset pulse input to the annunciation mode switch when can stop the activation of either the tactile or audible annunciator at anytime.

14 Claims, 5 Drawing Sheets

FIG. 1
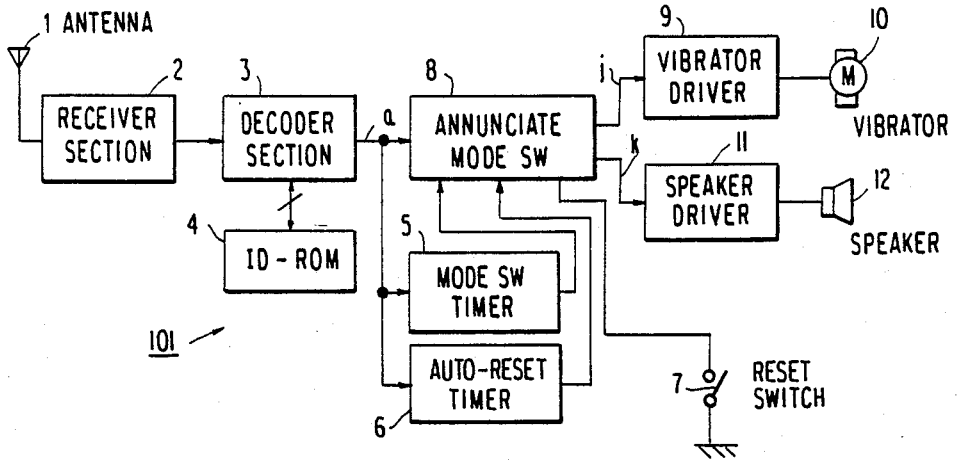
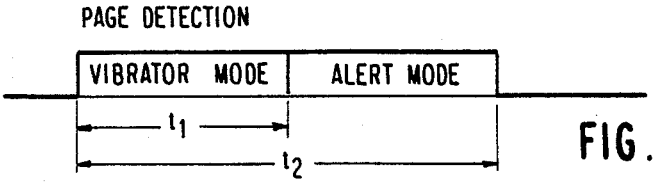
FIG. 2
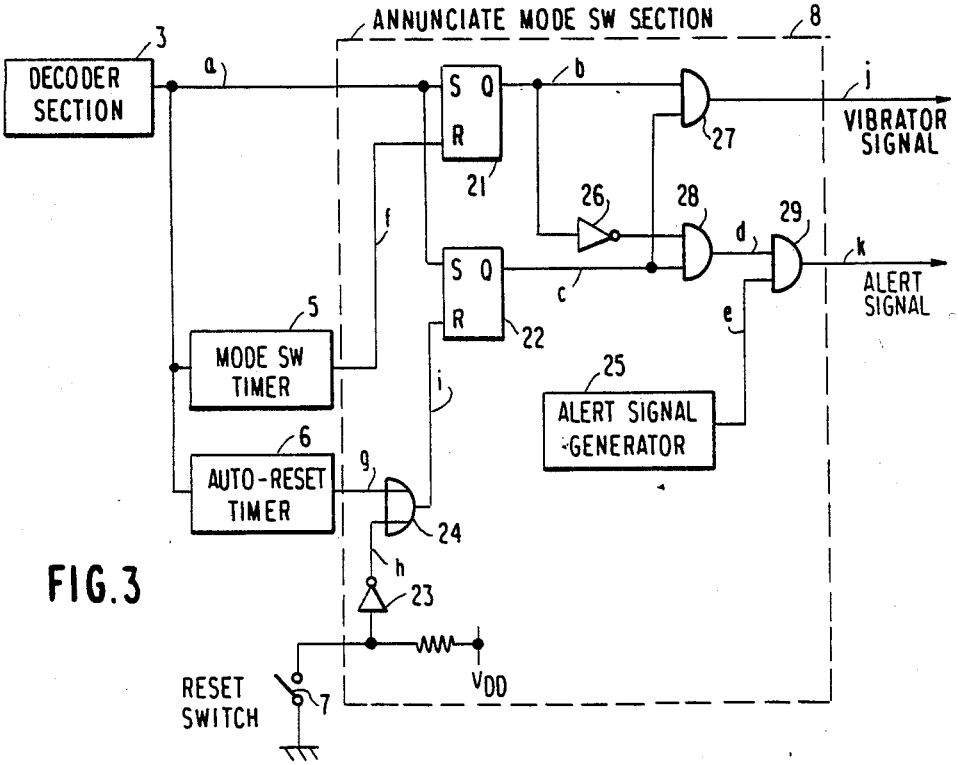
FIG. 3

DETECTION PULSE

MODE SWITCH PULSE
t1 t2

AUTO-RESET PULSE

VIBRATION MODE

ALERT MODE

DETECTION PULSE

MODE SWITCH PULSE

AUTO-RESET PULSE

MANUAL RESET PULSE

VIBRATION MODE

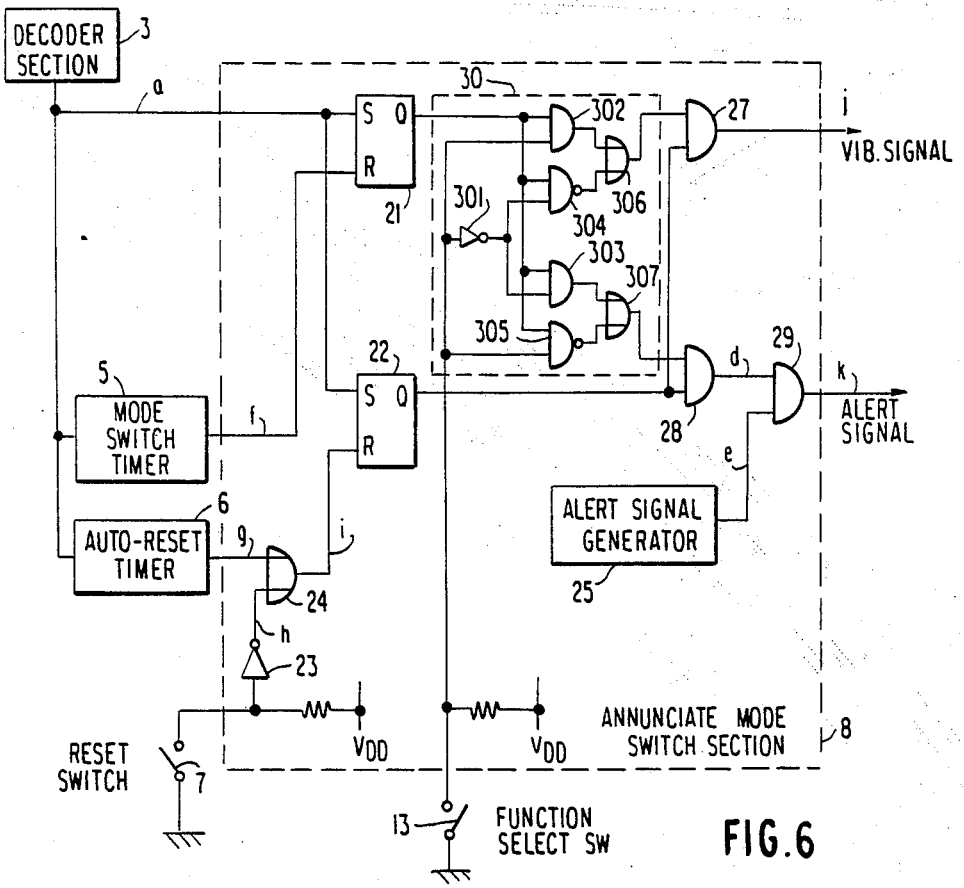
FIG.6
FIG.7
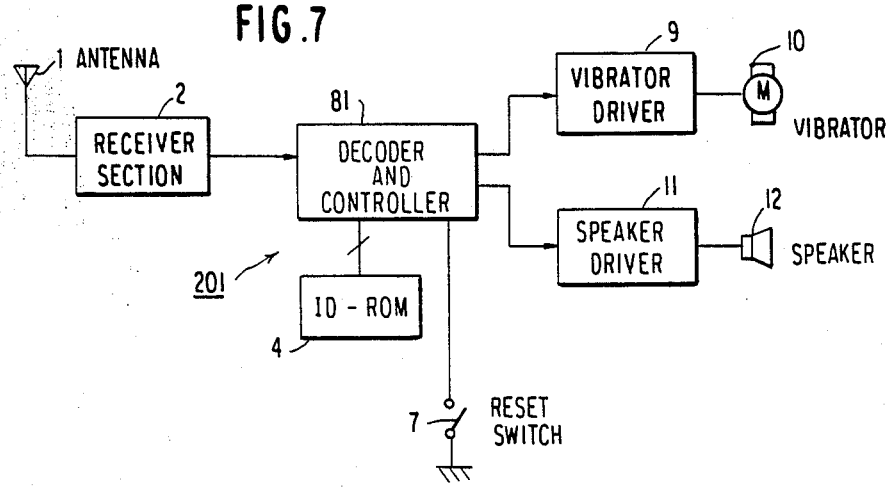

PAGING RECEIVER HAVING AUDIBLE AND VIBRATOR ANNUNCIATING MEANS

BACKGROUND OF THE INVENTION

The present invention relates to a paging receiver and, more particularly, to a paging receiver having an audible and a tactile annunciating means.

A prior art paging receiver, on confirmation of a call, notifies a person who carries the receiver of the call either in an alert mode which uses sound or in a vibrator mode which uses vibration or like tactile implementation. The person selects one of the alert mode and vibrator mode by manipulating a mechanical mode changeover switch. This type of paging receivers are disclosed in U.S. Pat. No. 4,352,091 (issued July 5, 1983) granted to the same inventor as the present invention, and U.S. Pat. No. 4,392,135 (issued July 5, 1983) granted to Ohyagi.

For example, when the person carrying the receiver selects the vibrator mode, he or she may put the receiver on a belt or in a pocket to physically sense vibration due to a call and, thereby, see the receipt of a call. In the alert mode, on the other hand, he or she confirms a call by hearing sound.

A prerequisite with the prior art paging receiver stated above is that in the vibrator mode a person has to constantly put the receiver on his or her body, i.e., putting it off the body would make it impossible for one to confirm a call. Hence, while the receiver is not on a person's body, the alert mode should necessarily be selected.

In practice, however, such mode changeovers impose a considerable burden on the user. It often occurs that a person puts the receiver away from his or her body without changing over the annunciation mode through negligence and, thereby, fails to notice a call.

Furthermore, even if the alert mode is selected, it is difficult for one to surely notice a call in a factory and other noisy environment which are apt to drown out the alert tone.

SUMMARY OF THE INVENTION

It is therefore an object of the present invention to provide a paging receiver capable of selectively annunciating a call by tactile such as vibration and by sound without resorting to manual mode changeover.

It is another object of the present invention to provide a paging receiver which continuously annunciates by vibration or by sound each for a predetermined period of time.

It is another object of the present invention to provide a paging receiver which allows one to stop annunciation by vibration and sound, each of which continues a predetermined period of time, by means of a reset switch.

It is another object of the present invention to provide a paging receiver which with a simple logic circuit performs annunciation by vibration and sound without the need for a changeover switch.

It is another object of the present invention to provide a paging receiver which with a one-chip central processing unit (CPU) performs annunciation by vibration and sound without the need for a changeover switch.

In accordance with the present invention, there is provided a paging receiver comprising receiver means for receiving a paging signal which includes a page number, memory means for storing a page number which is assigned to the receiver, decoder means for comparing the page number included in the paging signal received with the page number which is stored in the memory means, and producing a detection pulse if the two page numbers coincide, a first and a second timer means starting in response to the detection pulse, for producing, respectively, a mode switch pulse and an auto-reset pulse on lapse of a first and a second predetermined period of time, the first period of time being shorter than the second period of time, reset switch means for generating a manual reset pulse, and annunciation mode switching means for driving one of a tactile and an audible annunciator means in response to the detection pulse, stopping the one annunciator means driven and driving the other annunciator means in response to the mode switch, stopping the other annunciator means in response to the auto-reset pulse, and stopping the driven annunciator means in response to the manual reset pulse.

BRIEF DESCRIPTION OF THE DRAWINGS

The above and other objects, features and advantages of the present invention will become more apparent from the following detailed description taken with the accompanying drawings in which:

FIG. 1 is a schematic block diagram of a paging receiver embodying the present invention;

FIG. 2 is a timing chart representative of annunciation modes in which the receiver of FIG. 1 is selectively operable;

FIG. 3 is a block diagram showing an annunciation mode switching section and its associated circuit as shown in FIG. 1;

FIG. 6 is a block diagram showing a modification to the annunciation mode switching section of FIG. 3;

FIG. 7 is a schematic diagram showing another embodiment of the present invention.

DETAILED DESCRIPTION OF THE PREFERRED EMBODIMENTS

Figures 4A, 4B, 4C, 4D, 4E, 4F, 4G, 4H, 4I, 4J, 4K:
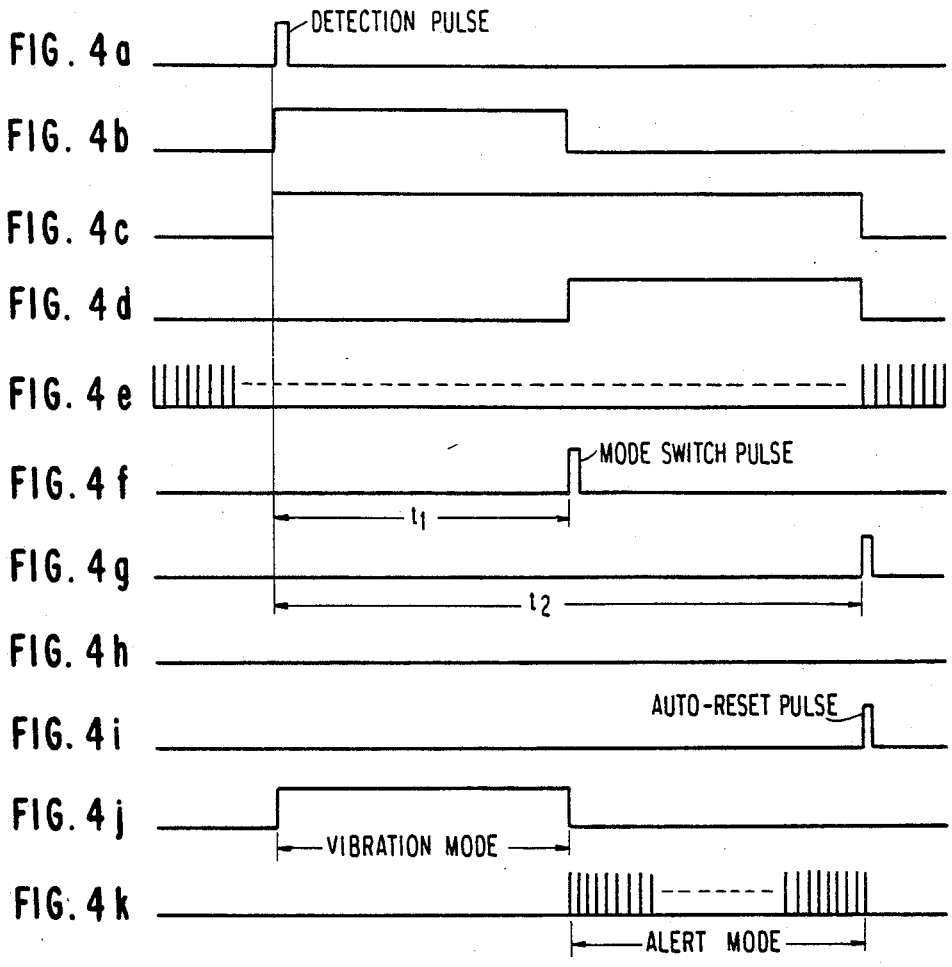
FIGS. 4*a*–4*k* are timing charts demonstrating an operation of the circuitry shown in FIG. 3.

Referring to FIG. 1 of the drawings, an antenna 1 picks up a paging signal and supplies it to a receiver section 2. Including an ordinary FM (frequency modulation) demodulating section, the receiver section 2 amplifies the received paging signal and converts its frequency and, then, demodulates it to produce a baseband signal. A page number which is included in the baseband signal is applied to a decoder section 3 to be compared with a page number which is assigned to a receiver 101 and stored in a read-only memory (ID-ROM) 4. If the two page numbers are the same, the decoder section 3 produces a detection pulse to show that a call has arrived at the receiver 101.

The output of the decoder section 3 is connected to a mode switching timer 5, an auto-reset timer 6, and an annunciate mode switching section 8. The outputs of the mode switching timer 5 and auto-reset timer 6 are connected to the annunciate mode switching section 8. The output of a reset switch 7 is also connected to the switching section 8. Started by an output signal of the decoder section 3, each of the mode switching timer 5 and auto-reset timer 6 generates a pulse on the lapse of a predetermined period of time. The reset switch 7 outputs a pulse when manually operated.

The annunciate mode switching section 8 generates a vibrator signal and an alert signal in response to a signal which is applied thereto from the decoder section 3. The mode of this section 8 is changed over by output signals of the mode switching timer 5 and auto-reset timer 6, whereby one of the vibrator and alert signals is delivered. A vibrator 10 which serves as a tactile annunciator means is connected to the annunciate mode switching section 8 via a vibrator driver 9. A speaker 12 is connected to the annunciate mode switching section 8 via a speaker driver 11. In this construction, the vibrator 10 and the speaker 12 are selectively driven by the vibrator and alert signals, respectively.

It is to be noted that the vibrator 10 is usually implemented with a miniature motor which is furnished with an eccentric motor for generating vibration, and the speaker 12 generates sound of an audible frequency.

As shown in FIG. 2, when receiving its own page number, the paging receiver 101 sequentially performs a vibrator mode operation and an alert mode operation for, respectively, predetermined periods of time of $t_1$ and $(t_2-t_1)$, thereby notifying the user of the receiver by both of vibration and sound.

Referring to FIG. 3, the announciate mode switching section 8 is shown in detail in a block diagram. As shown, this section 8 includes a first flip-flop 21 and a second flip-flop 22. The set terminal S of each flip-flop 21 or 22 is connected to the decoder section 3, and the reset terminal R of the flip-flop 21 is connected to the mode switching timer 5. A circuit made up of an inverter 23 and an OR gate 24 is connected to the reset terminal R of the flip-flop 22 such that output signals of the auto-reset timer 6 and reset switch 7 are fed to the flip-flop 22 by positive logic.

The mode switching section 8 further includes an alert signal generator 25 adapted to generate, for example, a 2 kHz intermittent signal. An inverter 26 and AND gates 27, 28 and 29 are connected to the output terminal of the alert signal generator 25 and to the Q outputs of the flip-flops 21 and 22 so as to constitute a logic circuit, whereby a signal is selectively delivered to the vibrator driver 9 and alert driver 11.

The operation of the paging receiver 101 (FIGS. 1 and 3) will be described with reference made to FIG. 4 as well. In FIG. 4, signals a to k correspond respectively to points a to k as shown in FIG. 3.

When the decoder section 3 detects a page number which is assigned to the receiver 101, it produces a detection pulse a. In response to this pulse a, the mode switching timer 5 and the auto-reset timer 6 are started. The timer 5 produces a mode switch pulse f on the lapse of a period of time $t_1$, and the timer 6 produces an auto-reset pulse g on the lapse of a period of time $t_2$ which, in this particular embodiment, is longer than the period of time $t_1$.

The detect pulse a from the decoder section 3 sets the flip-flops 21 and 22 resulting that signals b and c each becomes (logical) "1". Hence, the logic circuit makes a vibrator signal j "1" to trigger the vibrator driver 9 and, thereby, the vibrator 10 which then generates vibration. At this instant, because a signal d is "0",a signal e generated by the alert signal generator 25 is inhibited to maintain an alert signal k "0" and, therefore, the alert driver 11 is not enabled.

When the mode switching timer 5 generates the mode switch pulse f on the lapse of the period of time $t_1$, the flip-flop 21 is reset so that the signal b becomes "0". This turns the vibration signal j to "0" and, thereby, disables the vibrator 10. However, because the flip-flop 22 remains set, the signal d becomes "1" to cause the output signal e of the alert signal generator 25 to be delivered as the alert signal k. As a result, the alert driver 11 is enabled instead of the vibrator driver 9, whereby the speaker 12 is energized to produce audible sound.

Thereafter, on the lapse of the period of time $t_2-t_1$ (i.e., the period of time $t_2$ as counted from the detection of the page), the auto-reset timer 6 produces the auto-reset pulse g. Then, the second flip-flop 22, too, is reset by a pulse i resulting that the signal c becomes "0". Consequently, the delivery of the alert signal e from the alert signal generator 25 to the alert driver 11 is interrupted to stop the alert mode operation and, thereby, the annunciation.

Figures 5A, 5B, 5C, 5D, 5E, 5F, 5G, 5H, 5I, 5J, 5K:
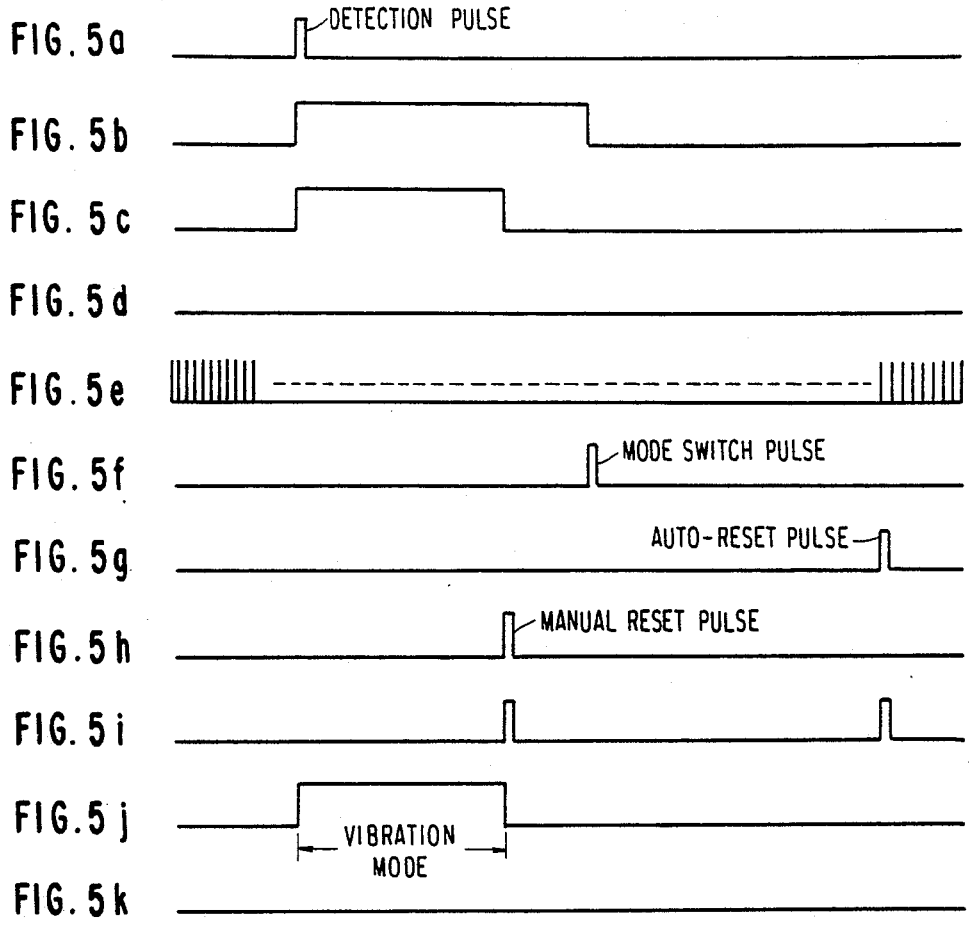
FIGS. 5*a*–5*k* are timing charts demonstrating another operation of the circuitry shown in FIG. 3;.

As shown in FIG. 5, assume that, irrespective of whether the page receiver 101 may be in the vibrator mode or in the alert mode, the reset switch 7 is closed to output manual reset pulses h and i. Then, the output of the flip-flop 22 becomes "0" to disable the AND gates 27 and 28, whereby both of the vibrator and alert operations are terminated immediately.

As described above, the paging receiver 101 responds to a call by automatically performing a vibrator operation and, then, an alert operation on the lapse of a predetermined period of time. This allows a person to notice a call by both of a vibrator operation and an alert operation while the receiver 101 is put on the person's body. Even if the receiver 101 is not put on the person's body, a call is annunciated without fail by an alert operation.

The automatic changeover from the alert mode to the vibrator mode can be accomplished by modifying a part of the previously stated logic circuit.

The sequence of two annunciation modes can be changed, if desired, with a circuit shown in FIG. 6. FIG. 6 shows a modification to the annunciate mode switching section of FIG. 3. In FIG. 6, a function select switch 13 is provided and connected, together with the outputs of the flip-flops 21 and 22, to a logic circuit which is made up of a logic circuit 30, which replaces the inverter 26 of FIG. 3, and the AND gates 27, 28 and 29. As shown, the logic circuit 30 includes an inverter 301, AND gates 302 and 303, NAND gates 304 and 305, and OR gates 306 and 307. In this construction, when the function select switch 13 is closed, the paging receiver 101 is sequentially operated in the alert mode and, then, in the vibrator mode, i.e., the relationship between the vibrator signal j and the alert signal k with respect to the duration of "1" is reversed.

Referring to FIG. 7, another embodiment of the present invention is shown in a block diagram. In FIG. 7, the same structural elements as those shown in FIG. 1 are designated by like reference numerals. As shown, the paging receiver, generally 201, includes a decoder and controller 81 which serves the functions of the decoder section 3, annunciate mode switching section 8, and two timers 5 and 6 of FIG. 1. The decoder and controller 81 may be implemented with μPD7503 available from NEC Corporation.

Figure 8:
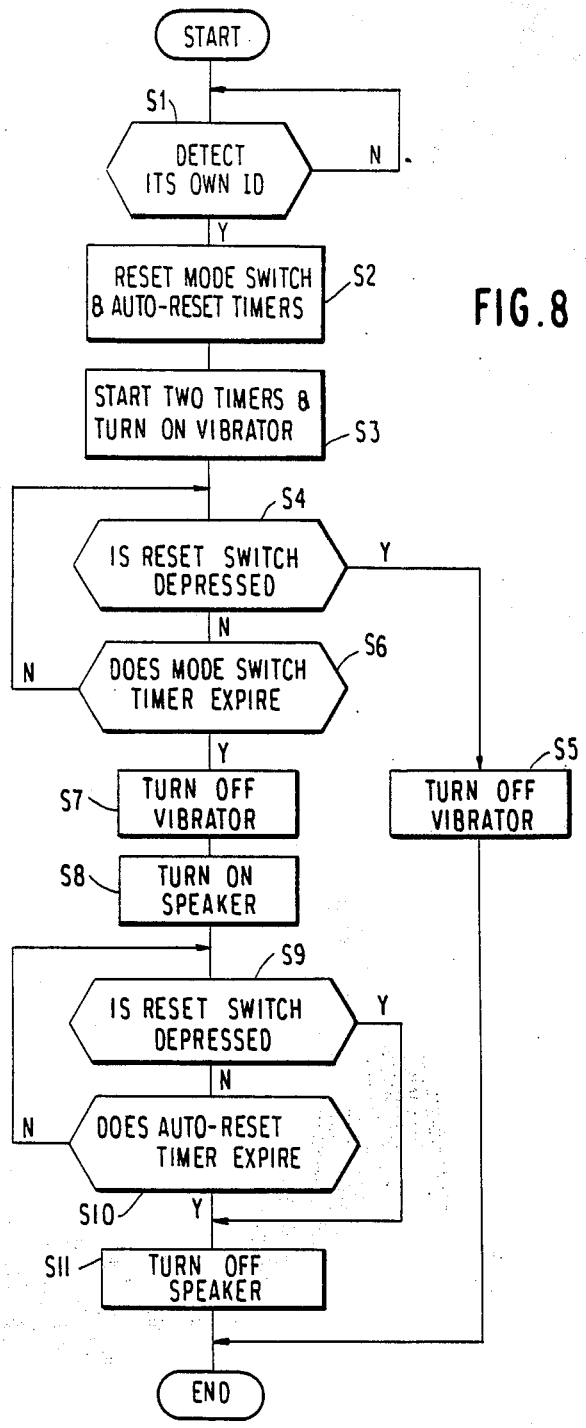
FIG. 8 is a flowchart demonstrating the operation of the paging receiver of FIG. 7.

The operation of the decoder and controller 81 will be described with reference to the flowchart of FIG. 8. In STEP S1, whether or not a paging signal from the receiver section 2 includes the page number assigned to the paging receiver 201 is determined by comparing the output of the receiver section 2 with the page number stored in the ID-ROM 4. If the page number is detected, the program advances to STEP S2 to reset a mode switching timer having the time $t_1$ and an auto-reset timer having the time $t_2$ ($t_1 > t_2$). Then, in STEP S3, the mode switching timer and the auto-reset timer are started while, at the same time, the vibrator signal j for driving the vibrator 10 is applied to the vibrator driver 9. This is followed by STEP S4 where whether the reset switch 7 is depressed or not is monitored. If the reset switch is depressed, the operation is transferred to STEP S5 to deenergize the vibrator 10 deciding that the user of the receiver has noticed the call.

If the reset switch 7 is not depressed as decided in STEP S4, the program advances to STEP S6 to see if the mode switching timer ($t_1$) is over. If it is not over, the operation is returned to STEP S4; if it is over, the operation advances to STEP S7 to stop the vibrator 10. Next, in STEP S8, the alert signal k for energizing the speaker 12 is applied to the speaker driver 11 and, in the following STEP S9, whether the reset switch 7 is depressed or not is monitored. If it is depressed, the program goes to STEP S11 to interrupt the alert signal i and, thereby, deenergize the speaker 12.

If the reset switch 7 is not depressed as determined in STEP S9, the program advances to STEP S10 to see if the auto-reset timer ($t_2$) is over. If it is not over, the operation is returned to STEP S9; if it is over, STEP S11 is performed.

In summary, it will be seen that the present invention provides a paging receiver which surely annunciates a call, whether the receiver be put on the user's body or not. This unprecedented advantage is derived from a unique arrangement in which a mode switching timer and an auto-reset timer that are started by an output signal of a decoder section are connected to an annunciate mode switching section, which effects a vibrator mode operation and an alert mode operation one after another. The mode switching section is operated by outputs of the two timers, whereby the annunciation mode is automatically switched from the vibrator mode to the alert mode or vice versa when a predetermined period of time expires.

What is claimed is:

1. A paging receiver comprising:

receiver means for receiving a paging signal which includes a page number;

memory means for storing a page number which is assigned to said receiver;

decoder means for comparing said page number including in said paging signal received with said page number which is stored in said memory means, and producing a detection pulse if said two page numbers coincide;

a first and a second timer means starting in response to said detection pulse, for producing, respectively, a mode switch pulse and an auto-reset pulse on lapse of a first and a second predetermined period of time, said first period of time being shorter than said second period of time;

reset switch means for generating a manual reset pulse;

a tactile and an audible annunciator means; and annunciation mode switching means for driving one of said annunciator means in response to said detection pulse, stopping said one annunciator means driven and driving the other annunciator means in response to said mode switch pulse, stopping said other annunciator means in response to said auto-reset pulse, and stopping the driven annunciator means in response to said manual reset pulse.

2. A paging receiver as claimed in claim 1, wherein said tactile annunciator means comprises a vibrator, and said audible annunciator means comprises a speaker.

3. A paging receiver as claimed in claim 2, wherein said decoder means and annunciation mode switching means comprise a one-chip central processing unit.

4. A paging receiver as claimed in claim 1, further comprising a function select switch means for generating an annunciation sequence switch pulse, said mode switching means switching the driving order of said tactile and audible annunciator means in response to said annunciation sequence switch pulse.

5. A paging receiver as claimed in claim 3, wherein said mode switching means comprises:

a first flip-flop having a set terminal and a reset terminal to which said detection pulse and said mode switch pulse, respectively, are applied;

a second flip-flop having a set terminal and a reset terminal to which said detection pulse and one of said auto-reset pulse and said manual reset pulse, respectively, are applied;

a first two-input AND gate to which the Q terminal output of said first flip-flop and said annunciation sequence switch pulse are applied;

a second two-input AND gate to which the Q terminal output of said first flip-flop and an inverted pulse of said annunciation sequence switch pulse are applied;

a first two-input NAND gate to which the Q output of said first flip-flop and an inverted pulse of said annunciation sequence switch pulse are applied;

a second two-input NAND gate to which the Q terminal output of said first flip-flop and said annunciation sequence switch pulse are applied;

a first two-input OR gate to which the outputs of said first two-input AND and said first two-input NAND gates are applied;

a second two-input OR gate to which the outputs of said second two-input AND and said second two-input NAND gates are applied;

a third two-input AND gate responsive to the output of said first two-input OR gate and the Q terminal output of said second flip-flop for producing a signal which drives said tactile annunciator means;

a fourth two-input AND gate to which the output of said second two-input OR gate and the Q terminal output of said second flip-flop are applied;

an alert signal generator for generating a signal having an audible frequency; and a fifth two-input AND gate responsive to the output of said fourth two-input AND gate and said signal having an audible frequency for producing a signal which drives said audible annunciator means.

6. A paging receiver as claimed in claim 1, wherein said mode switching means comprises:

a first flip-flop having a set terminal and a reset terminal to which said detect pulse and said mode switch pulse, respectively, are applied;

a second flip-flop having a set terminal and a reset terminal to which said detect pulse and one of said autoreset pulse and said manual reset pulse, respectively, are applied;

a first two-input AND gate responsive to the Q terminal outputs of said first and second flip-flops for producing a signal which drives said tactile annunciator means;

a second two-input AND gate to which an inverted signal of the Q terminal output of said first flip-flop and the Q terminal output of said second flip-flop are applied;

an alert signal generator for generating a signal having an audible frequency; and a third two-input AND gate responsive to the output of said second two-input AND gate and said signal having an audible frequency for driving said audible annunciator means.

7. A paging receiver comprising:

detector means for detecting a pager signal which is assigned to said receiver, to produce a detection pulse;

a tactile and an audible annunciator means; and an annunciation control means responsive to said detection pulse for automatically and sequentially driving said tactile and audible annunciator means for a first and a second predetermined period of time, respectively, wherein said annunciation control means comprises a mode switch timer responsive to said detection pulse for counting said first predetermined period of time, and an auto-reset timer responsive to said detection pulse for counting a period of time which is a sum of said first and second predetermined periods of time.

8. A method of controlling a tactile and an audible annunciator means of a paging receiver, comprising the steps of:

producing a detection pulse by detecting a page number which is assigned to said receiver;

in response to said detection pulse, starting a first and a second timer having, respectively, a first and a second period of time and driving one of said tactile and audible annunciator means, said first period of time being shorter than said second period of time;

in response to the time-over of said first timer, stopping one of said annunciator means driven and driving the other annunciator means;

stopping said other annunciator means in response to the time-over of said second timer; and stopping one of said annunciator means being driven in response to a reset pulse.

9. A method of controlling the tactile and audible annunciator means of a paging receiver, comprising the steps of:

receiving a paging signal which includes a page number;

storing a page number which is assigned to said receiver;

comparing said page number included in said paging signal received with said page number stored and, if said two page numbers coincide, producing a detection pulse;

in response to said detection pulse, starting a first and a second timer having, respectively, a first and a second predetermined period of time, said second predetermined period of time being longer than said first predetermined period of time;

driving one of said tactile and audible annunciator means in response to said detection pulse;

in response to the time-over of said first timer, stopping said one annunciator means driven and driving the other annunciator means; and stopping said other annunciator means in response to the time-over of said second timer.

10. A method as claimed in claim 9, further comprising the steps of manually generating a reset pulse, and stopping the annunciator means driven in response to said reset pulse and irrespective of whether said first and second timers are over.

11. A method as claimed in claim 9, further comprising the step of manually generating an annunciation sequence switch pulse, and switching a driving order of said tactile and audible annunciator means in response to said annunciation sequence switch pulse.

12. A method of controlling annunciator means of a paging receiver, comprising the steps of:

receiving a paging signal which includes a page number;

storing a page number which is assigned to said receiver;

comparing said page number included in said paging signal received with said page number stored and, if said two numbers coincide, producing a detection pulse;

driving one of a tactile and audible annunciator means of said receiver for a first predetermined period of time in response to said detection pulse; and automatically driving the other annunciator means for a second predetermined period of time on lapse of said first predetermined period of time.

13. A method as claimed in claim 12, further comprising the steps of generating a first pulse, and stopping the annunciator means driven in response to said first pulse irrespective of said first and second predetermined periods of time.

14. A method as claimed in claim 13, further comprising the steps of generating a second pulse, and switching a driving order of said tactile and audible annunciator means in response to said second pulse.

* * * * *